US005732647A

United States Patent [19]

Bennmo

[11] Patent Number: 5,732,647

[45] Date of Patent: Mar. 31, 1998

[54] DEVICE AND A METHOD FOR TYING AND UNTYING A TUG LINE AT A SHIP

[76] Inventor: Ingvar Bennmo, PL 1601, S-440 06, Gräbo, Sweden

[21] Appl. No.: 640,853

[22] PCT Filed: Nov. 9, 1994

[86] PCT No.: PCT/SE94/01052

§ 371 Date: May 10, 1996

§ 102(e) Date: May 10, 1996

[87] PCT Pub. No.: WO95/13210

PCT Pub. Date: May 18, 1995

[51] Int. Cl.[6] ..... B63B 21/04

[52] U.S. Cl. ..... 114/251; 114/230

[58] Field of Search ..... 114/219, 230, 114/249, 251, 253, 254

[56] References Cited

U.S. PATENT DOCUMENTS

| | | | |
|---|---|---|---|
| 4,067,281 | 1/1978 | Walker et al. | 114/219 |
| 4,387,659 | 6/1983 | Terauchi et al. | 114/119 |

FOREIGN PATENT DOCUMENTS

| | | | |
|---|---|---|---|
| 99489 | 6/1982 | Japan | 114/253 |

OTHER PUBLICATIONS

Patent Abstracts of Japan, vol. 12, No. 212, (M-710), Abstract of JP A 63-13887, Mitsubishi Heavy Ind LTD, Jan. 21, 1988.

Derwent's Abstract, No. 84-193863/31, Week 8431, Abstract of SU 1057366 A, Gorki River Fleet, Nov. 30, 1983.

*Primary Examiner*—Jesus D. Sotelo

*Attorney, Agent, or Firm*—Robert Platt Bell & Associates, P.C.

[57] ABSTRACT

A device and a method for engaging and disengaging of a towing line from a tow boat to and from a ship. At the ship there is a hawse hole (5), a bollard head (1) and a working for inhauling of a messenger rope (4), attached to the lop of the towing line (3). The device is especially characterized in that a guide means, like a hook (2), is attached to the ship in such a way, between the bollard head (1) and the working (7), so that the messenger rope (4) guided by the second guide means (2) can pull the loop of the towing line (3) near and above the bollard head (1) so that this easily can be engaged around the bollard head (1), whilst the messenger rope (4), free from the second guide means (2), by the working (7) can lift the loop inwardly, up above the bollard head (1) so that the towing line can be taken on board by the tow boat.

11 Claims, 5 Drawing Sheets

7
4
2
1
3
5

DEVICE AND A METHOD FOR TYING AND UNTYING A TUG LINE AT A SHIP

FIELD OF THE INVENTION

The present invent on relates m a device and a method for engaging and disengaging of a towing line, in one end formed like a loop, to and from a ship, at which there are provided, substantially in one common vertical plane, a first guide means in the form of a hawse-hole, a boltard head, around which said loop is intended to be engaged, and a working for inhauling of a messenger rope, attached to the towing line.

BACKGROUND OF THE INVENTION

The work on board a ship, engaging and disengaging a towing line from a tow boat to a ship means, with the equipment hitherto available, and considering the limited crew nowadays on board, considerable risks for accidents. Engaging and disengaging have furthermore hitherto been arduous.

SUMMARY OF THE INVENTION

The object of the invention is to provide a device and a method of the art mentioned introductorily, that admits safe and simple engaging and disengaging of a towing line from a tow boat to and from a ship.

A device according m the invention is primarily characterized by a second guide means, attached to the ship between the bollaxd head and the working, a first line between the hawse-hole and the second guide means running relatively close above the bollard head whilst a second line between the hawse-hole and the working, runs relatively high above the bollard head so that the messenger rope, guided by the second guide means substantially following the first line admits engaging of the loop of the towing line around the bollard head, whilst the messenger rope, free from the second guide means, substantially following the second line, admits disengaging of the loop of the towing line from the bollard head. This device and cormponding method warrant engaging and disengaging without risk and with a limited manpower effort.

In one preferred embodiment of the device according to the invention a third guide means is attached to the ship between the bollard head and the hawse-hole, provided to guide, when engaging, the loop of the towing line in a horizontal plane to warrant the engaging of the loop around the bollard head. With this embodiment the engaging and disengaging will be even more safe and even less demanding for manpower effort.

Per se the second guide means can be formed in different ways, but it has proved to be suitable to form it like a hook with the opening downwards. The third guide means is advantageously formal like a horizontal bar, in one end carried by a leg, and it is suitably located in the vicinity of the bollard head.

BRIEF DESCRIPTION OF THE DRAWINGS

The invention shall now be described more closely, reference being made to the enclosed figures, which show two embodiments of a device according to the invention.

In the enclosed figures, which are all schematical.

Figure 1B:
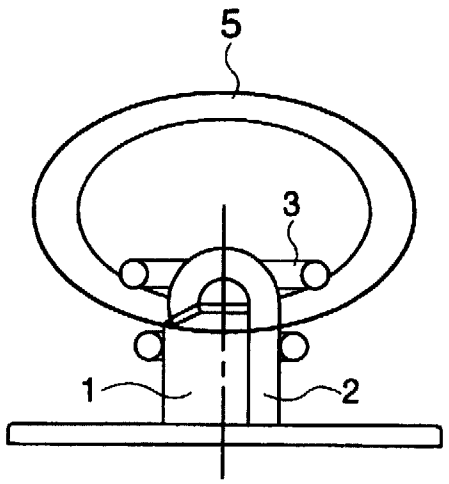
FIGS. 1*a–b* show side views of parts of a first embodiment of the invention.
Figure 1A:
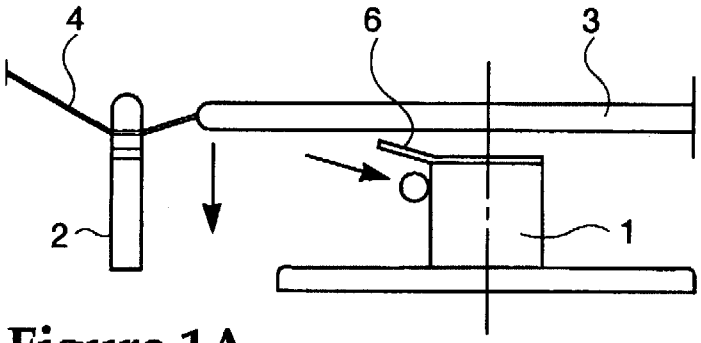
Figure 1C:
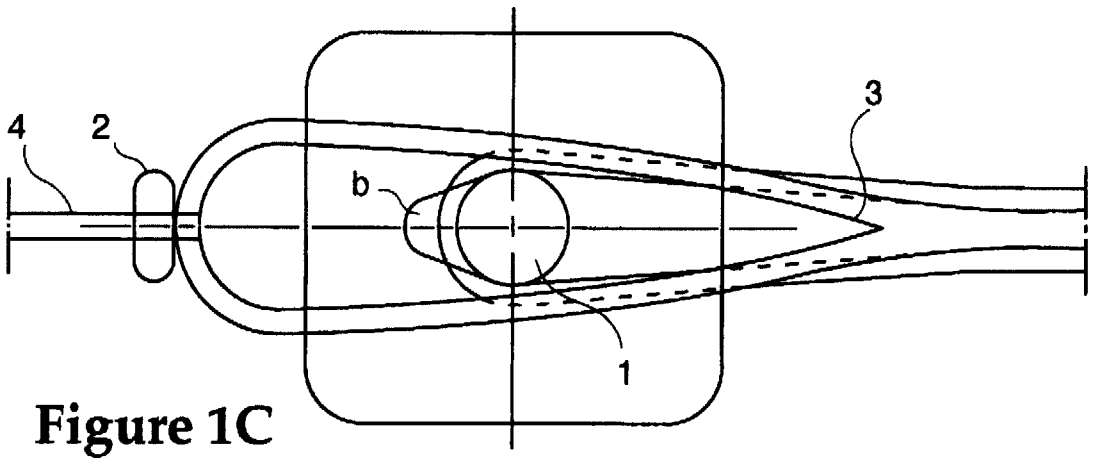
Figure 2A:
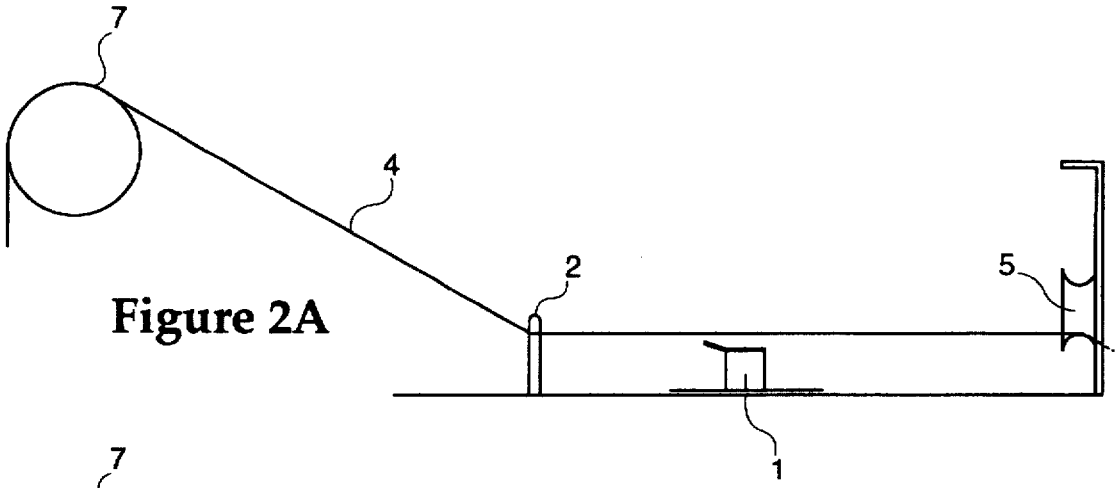
Figure 2B:
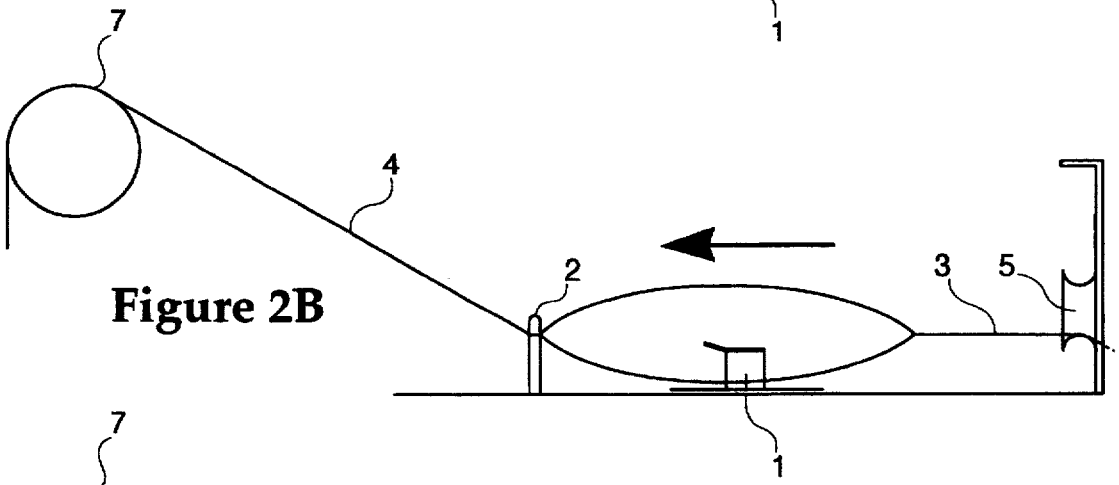
Figure 2C:
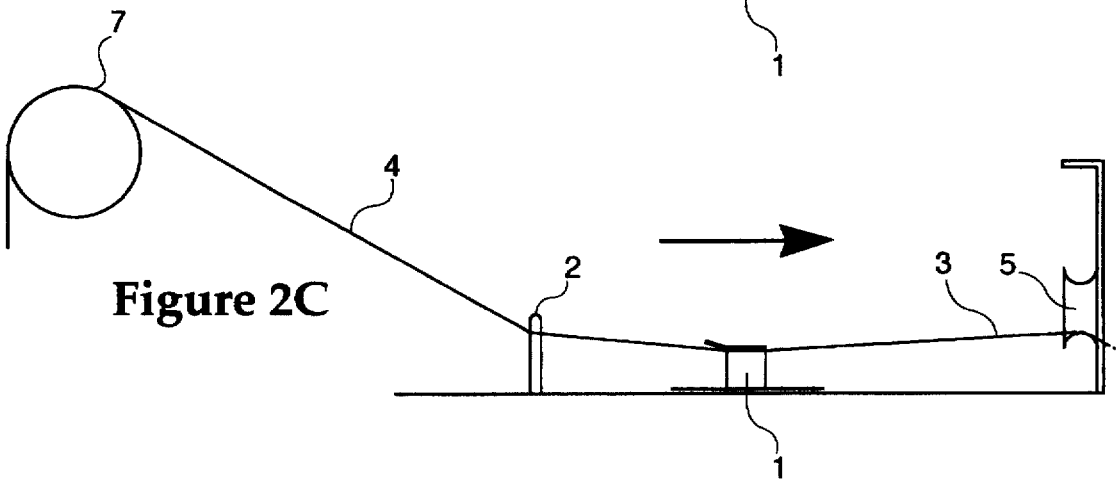
Figures 3A, 3B, 3C:
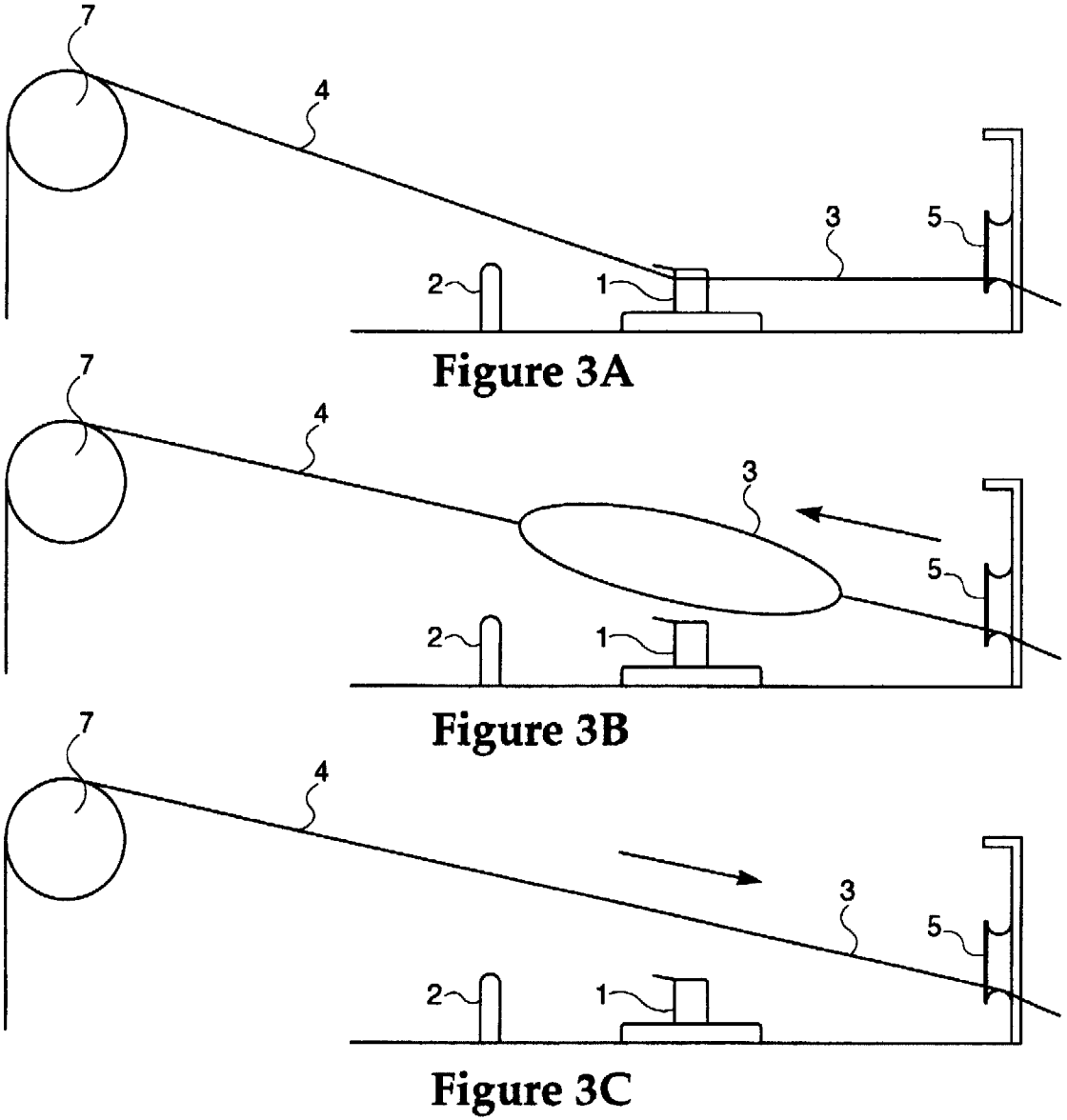
Figure 4A:
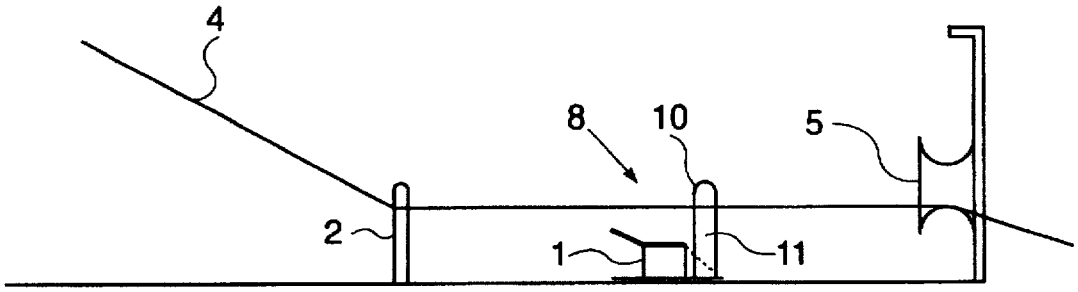
Figure 4B:
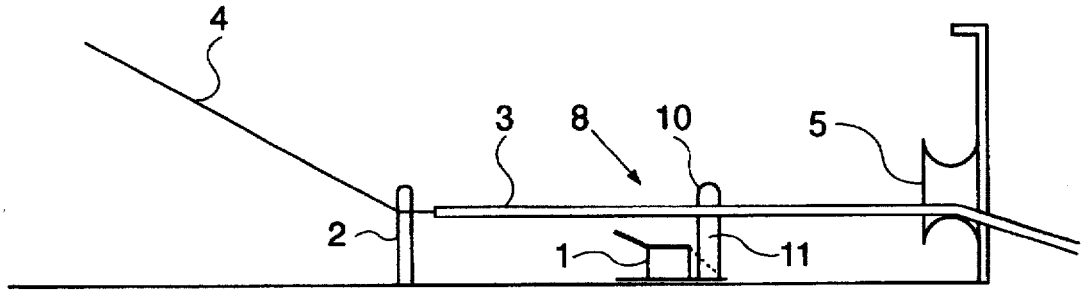
Figure 4C:
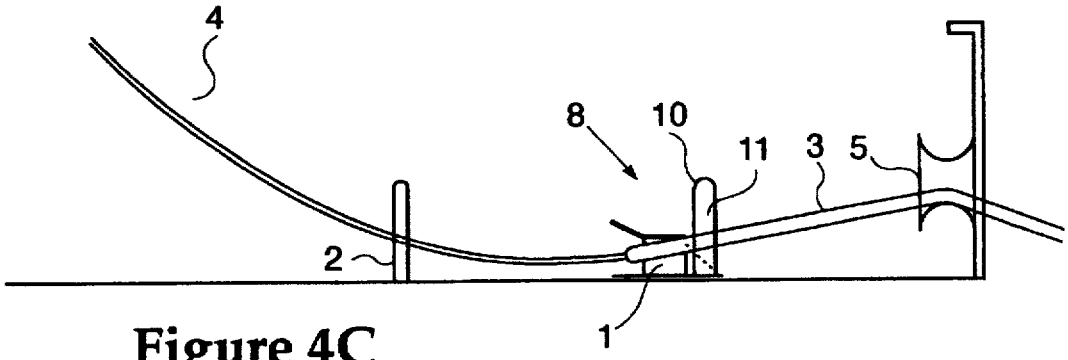
Figure 5A:
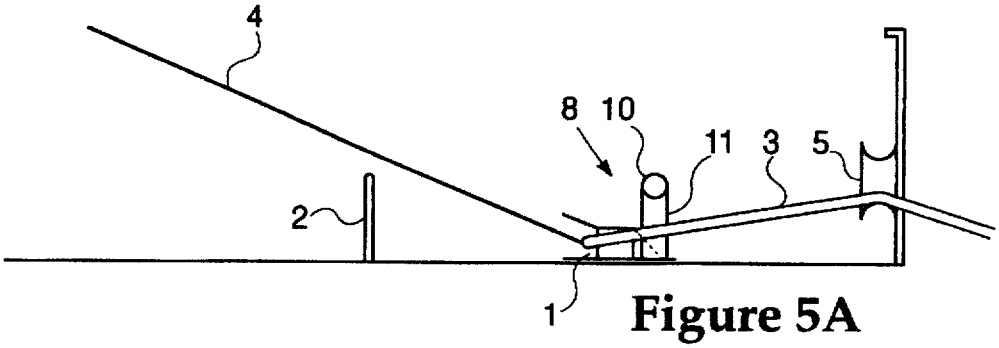
Figure 5B:
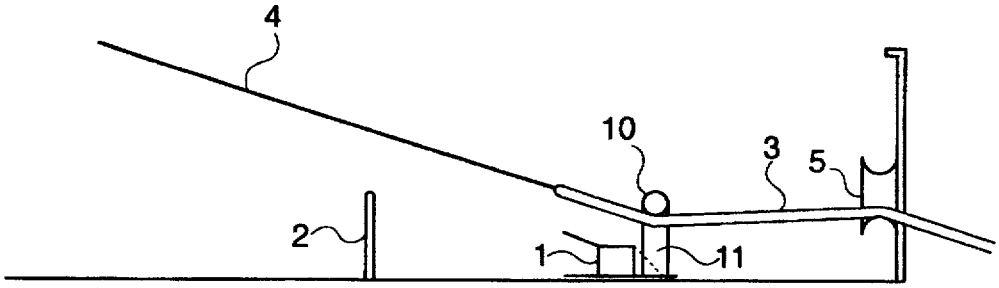
Figure 5C:
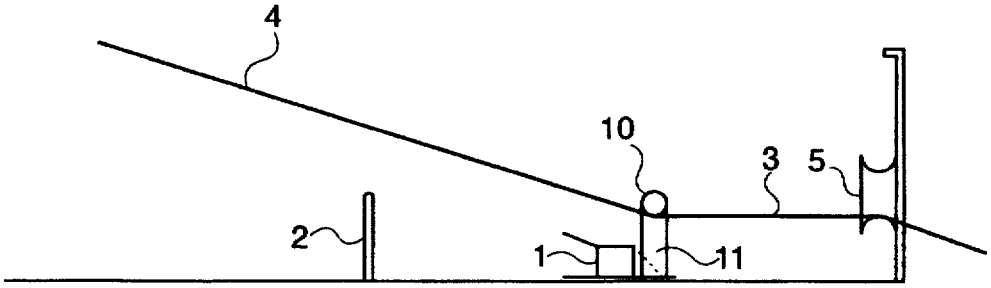
Figure 6:
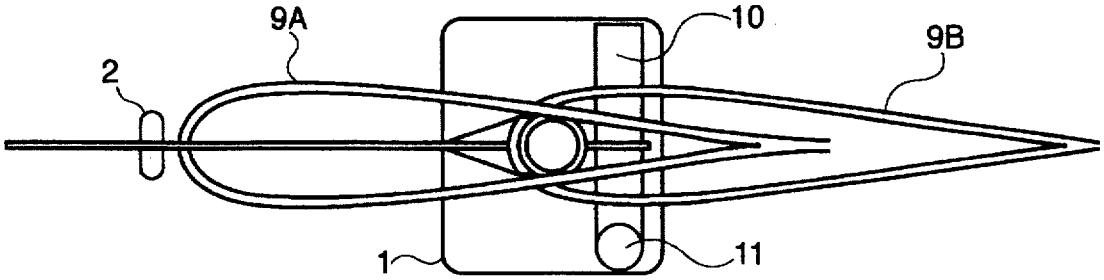

FIG. *c* shows a view from above of parts of the embodiment in FIGS. 1 *a b*,,

FIGS. 2*a–c* show engaging of a towing line at an embodiment in FIGS. 1*a–c*,

FIGS. 3*a–c* show disengaging of a towing line at the embodiment in FIGS. 1*a–c*, FIGS. 4*a–c* show engaging of a towing line at a second embodiment of the invention, FIGS. 5*a–c* show disengaging of a towing line at the embodiment in FIGS. 4*a–c*, FIG. 6 shows a view from above of parts of a second embodiment of the invention.

DETAILED DESCRIPTION OF THE INVENTION

In the figures 1 refers to bollard head with a sliding shield 6. A hawse-hole provided in a plate at the side of the ship is referred to as 5, and a hook, attached to the deck of the ship is 2. The hawse-hole 5, the bollard head 1 and the hook 2 are located in such a way, that a common vertical plane can be laid through them. A working 7 (e.g., winch or the like) is only indicated in the FIGS. 2 and 3.

The procedure when engaging the towing line is seen in FIGS. 2 *a–c*. In FIG. 2*a* there is shown how the messanger rope is pulled from the working 7, below the hook 2, above the bollard head 1 and out through the hawse-hole to a tow boat, which is not shown. FIG. 2*b* shows how the towing line 3 with its loop has been pulled above and past the bollard head 1, and FIG. 2*c* shows how the towing linc 3 has been laid around the bollard head 1 by making the the messenger rope 4 yield from the working when the towing line 3 has been taken on board from the the tow boat.

Disengaging is shown in FIGS. 3*a–c*. FIG. 3*a* shows the messenger rope 4, free from the hook 2, ready to be pulled in by the working, so that the loop of the towing line 3 can be lifted inwardy and up above the bollard 1, according to FIG. 3*b*, whereafter the towing line 3 is taken on board by the tow boat whilst the working yields the messenger rope 4.

In FIGS. 4*a–c* there is shown engaging of a towing line at a second embodiment of a device according to the invention. The working is not shown in these figures or FIGS. 5 *a–c*. When compared with the first embodiment, described above, here has been added a third guide, means 8, in the form of a horizontal bar 10, in one end carrid by a vertical leg 11, attached to the deck of the ship. As is seen more distinctly in FIG. 6 due loop of the towing line is guided from a starting position 9*a* horizontally in a plane by the bar 10, so that it will lie safely around the bollard head in the final position 9*b*.

Disengaging the towing line is seen in FIGS. 5*a–c*.

I claim:

1. A device for engaging and disengaging a towing line having a loop, to and from a ship, comprising:

a first guide means in the form of a hawse-hole;

a bollard head substantially in one common vertical plane with said first guide means, around which said loop is intended to be engaged;

a winch substantially in one common vertical plane with said first guide means and said bollard head for inhauling of a messenger rope, attached to the towing line; and a second guide means substantially in one common vertical plane with said first guide means, said bollard head and said winch, and substantially in one common horizontal plane with a top surface of said bollard head and said first guide means, said second guide means attached to the ship between the bollard head and the winch, wherein a first line between the hawse-hole and the second guide means runs relatively close above the bollard head, wherein a second line between the hawse-hole and the winch, runs relatively high above the bollard head, such that the messenger rope guided by the second guide means substantially following the first line admits engaging of the loop of the towing line around the bollard head, and wherein the messenger rope, free from the second guide means, substantially following the second line, admits disengaging of the loop of the towing line from the bollard head.

2. A device for engaging and disengaging of a towing line (3), in one end formed like a loop, to and from a ship, at which there are provided, substantially in one common vertical plane, a first guide means in the form of a hawse-hole (5), a bollard head (1), around which said loop is intended to be engaged, a working (7) for inhauling of a messenger rope (4), attached to the towing line (3), characterized by a second guide means (2), attached to the ship between the bollard head (1) and the working (7), a first line between the hawse-hole (5) and the second guide means (2) running relatively close above the bollard head (1), whilst a second line between the hawse-hole (5) and the working (7), runs relatively high above the bollard head (1), so that the messenger rope (4) guided by the second guide means (2) substantially following the first line admits engaging of the loop of the towing line (3) around the bollard head (1), whilst the messenger rope (4), free from the second guide means, substantially following the second line, admits disengaging of the loop of the towing line (3) from the bollard head (1), further characterized by a third guide means (8) attached to the ship between the bollard head (1) and the hawse-hole, provided, when engaging the towing line (3), to guide the loop (9*a*,9*b*) of the towing line (3) horizontally in a plane to warrant engaging of the loop around the bollard head (1).

3. A device according to claim 2, characterized in that the third guide means (8) is formed like a horizontal bar (10), in one end carried by a leg (11).

4. A device according to claim 2, characterized in that the third guide means (8) is provided in the vicinity of the bollard head (1).

5. A device for engaging and disengaging of a towing line (3), in one end formed like a loop, to and from a ship, at which there are provided, substantially in one common vertical plane, a first guide means in the form of a hawse-hole (5), a bollard head (1), around which said loop is intended to be engaged, a working (7) for inhauling of a messenger rope (4), attached to the towing line (3), characterized by a second guide means (2), attached to the ship between the bollard head (1) and the working (7), a first line between the hawse-hole (5) and the second guide means (2) running relatively close above the bollard head (1), whilst a second line between the hawse-hole (5) and the working (7), runs relatively high above the bollard head (1), so that the messenger rope (4) guided by the second guide means (2) substantially following the first line admits engaging of the loop of the towing line (3) around the bollard head (1), whilst the messenger rope (4), free from the second guide means, substantially following the second line, admits disengaging of the loop of the towing line (3) from the bollard head (1), further characterized in that the second guide means (2) is formed like a hook with the opening downwards.

6. A method for engaging and disengaging a towing line having a loop, to and from a ship, at which there are provided, substantially in a common vertical plane, a first guide means in the form of a hawse-hole, a bollard head, a winch for inhauling of a messenger rope, and a second guide means, substantially in a common horizontal plane with the first guide means and a top surface of the bollard head, said method for engaging comprising the steps of:

attaching the messenger rope to the towing line, pulling the messenger rope with the winch guided by the second guide means above the top surface of the bollard head, and stopping the winch, so that the loop can be engaged around the bollard head; and said method for disengaging comprising the steps of:

releasing the messenger rope from the second guide means, pulling the messenger rope with the winch so that the loop of the towing line is lifted relatively high up above the top surface of the bollard head, and pulling the towing line from the ship.

7. A method for engaging and disengaging of a towing line (3), in one end formed like a loop , to and from a ship, at which there are provided, substantially in a common vertical plane;

a first guide means in the form of a hawse-hole, a bollard head (1), a working (7) for inhauling of a messenger rope (4), characterized in that:

for engaging, the messenger rope (4) is attached to the towing line (3), and is pulled by the working (7), guided by a second guide means (2), above the upper part of the bollard head (1), whereupon the working (7) yields, so that the loop can be engaged around the bollard head (1), and for disengaging, the messenger rope (4) free from the second guide means (2) is pulled from the working (7) so that the loop of the towing line (3) is lifted relatively high up above the upper part of the bollard head (1), to that the towing line (3) can be pulled from the ship, further characterized in that when engaging, the loop (9*a*,9*b*) of the towing line (3) is guided horizontally in a plane by a third guide means (8) to warrant engaging of the loop (9*a*,9*b*) around the bollard head (1).

8. An apparatus for engaging and disengaging a line having a loop in one end, comprising:

a first guide means;

a bollard head provided substantially in a common vertical plane with said first guide means, said bollard head for engaging said loop of said line;

a winch provided substantially in the common vertical plane with said first guide means and said bollard head, said winch for inhauling of a messenger rope attached to the line;

a second guide means between the bollard head and the winch; and a third guide means between the bollard head and the first guide means, provided, when engaging the line, to guide the loop of the line horizontally in a plane to engage the loop around the bollard head, wherein a first path between the first guide means and the second guide means runs relatively close above the bollard head, and a second path between the first guide means and the winch, runs relatively high above the bollard head, wherein the messenger rope guided by the second guide means substantially following the first path admits engaging of the loop of the line around the bollard head, and wherein the messenger rope, free from the second guide means, substantially following the second path, admits disengaging of the loop of the line from the bollard head.

9. An apparatus for engaging and disengaging a line having a loop in one end, comprising:

a first guide means;

a bollard head provided substantially in a common vertical plane with said first guide means, said bollard head for engaging said loop of said line;

a winch provided substantially in the common vertical plane with said first guide means and said bollard head, said winch for inhauling of a messenger rope attached to the line; and a second guide means between the bollard head and the winch, said second guide means formed like a hook with an opening downwards, wherein a first path between the first guide means and the second guide means runs relatively close above the bollard head, and a second path between the first guide means and the winch, runs relatively high above the bollard head, wherein the messenger rope guided by the second guide means substantially following the first path admits engaging of the loop of the line around the bollard head, and wherein the messenger rope, free from the second guide means, substantially following the second path, admits disengaging of the loop of the line from the bollard head.

10. A method for engaging and disengaging a towing line having a loop, to and from a ship, at which there are provided, substantially in a common vertical plane, a first guide means in the form of a hawse-hole, a bollard head, a winch for inhauling of a messenger rope, a second guide means between the bollard head and the winch, and a third guide means between the first guide means and the bollard head, said method for engaging comprising the steps of:

attaching the messenger rope to the towing line, pulling the messenger rope with the winch guided by the second guide means above a top surface of the bollard head, stopping the winch, and guiding the loop of the towing line horizontally in a plane by the third guide means to engage the loop around the bollard head; and said method for disengaging comprising the steps of:

releasing the messenger rope from the second guide means, pulling the messenger rope with the winch so that the loop of the towing line is lifted relatively high up above the top surface of the bollard head, and pulling the towing line from the ship.

11. A device for engaging and disengaging a towing line having a loop, to and from a ship, comprising:

a first guide means;

a fixed bollard head substantially in one common vertical plane with said first guide means, around which said loop is intended to be engaged;

a winch substantially in one common vertical plane with said first guide means and said bollard head for inhauling of a messenger rope, attached to the towing line; and a fixed second guide means located between and in substantially one common vertical plane with, the bollard head and the winch.

* * * * *